US009725954B2

(12) United States Patent
Graham, Sr.

(10) Patent No.: US 9,725,954 B2
(45) Date of Patent: Aug. 8, 2017

(54) LADDER SUPPORT

(71) Applicant: Donald Alan Graham, Sr., Northglenn, CO (US)

(72) Inventor: Donald Alan Graham, Sr., Northglenn, CO (US)

( * ) Notice: Subject to any disclaimer, the term of this patent is extended or adjusted under 35 U.S.C. 154(b) by 0 days.

(21) Appl. No.: 15/077,917

(22) Filed: Mar. 23, 2016

(65) Prior Publication Data

US 2016/0201392 A1 Jul. 14, 2016

Related U.S. Application Data

(62) Division of application No. 13/969,509, filed on Aug. 17, 2013, now Pat. No. 9,366,083.

(51) Int. Cl.

| | |
|---|---|
| ***E06C 1/18*** | (2006.01) |
| ***E06C 7/18*** | (2006.01) |
| ***E06C 7/42*** | (2006.01) |
| ***E06C 7/48*** | (2006.01) |

(52) U.S. Cl.

CPC ..... *E06C 7/188* (2013.01); *E06C 7/42* (2013.01); *E06C 7/48* (2013.01)

(58) Field of Classification Search

CPC ..... E06C 7/181; E06C 7/182; E06C 7/183; E06C 7/423; E06C 7/46; E06C 7/486; E06C 7/48; E06C 7/18; E06C 7/188; E06C 7/482; E06C 7/484; E06C 7/488; E06C 5/36; E06C 1/345; E06C 1/36

See application file for complete search history.

(56) References Cited

U.S. PATENT DOCUMENTS

| | | | | | |
|---|---|---|---|---|---|
| 972,001 | A | * | 10/1910 | Holdorf | E06C 7/48 182/214 |
| 2,523,535 | A | * | 9/1950 | Little | E06C 7/46 182/107 |
| 4,175,641 | A | * | 11/1979 | Reyes | E06C 1/22 182/108 |
| 4,359,138 | A | * | 11/1982 | Kummerlin | E06C 7/16 182/107 |
| 4,369,860 | A | * | 1/1983 | Beane | E06C 7/486 182/107 |
| 4,394,887 | A | * | 7/1983 | Spinks | E06C 7/48 182/107 |
| 4,941,547 | A | * | 7/1990 | Livick | E06C 7/16 182/107 |

(Continued)

*Primary Examiner* — Katherine Mitchell
*Assistant Examiner* — Shiref Mekhaeil
(74) *Attorney, Agent, or Firm* — Roger A. Jackson

(57) ABSTRACT

An apparatus and method of use for a ladder support for use with a ladder, with the ladder support for use between an upper roof and a lower roof with a gutter, wherein the ladder supported is between the lower and upper roofs. The ladder support includes an extension strut that has a channel shaped structure on one end, wherein the channel is operative to receive a ladder rung, with the other end of the extension strut having an angle beam with a primary leg portion and a secondary leg portion, the primary leg portion is attached to the extension strut. Wherein the secondary leg portion is operative to be disposed within the gutter, wherein operationally the ladder support helps to secure the ladder upon the lower roof as the ladder is leaning against the upper roof making the ladder more secure between the lower and upper roofs.

3 Claims, 10 Drawing Sheets

(56) References Cited

U.S. PATENT DOCUMENTS

| | | | | | |
|---|---|---|---|---|---|
| 5,261,507 | A * | 11/1993 | Williams | E06C 7/48 | 182/214 |
| 5,358,071 | A * | 10/1994 | Stennett | E04D 13/12 | 182/107 |
| 5,590,739 | A * | 1/1997 | High | E06C 1/12 | 182/169 |
| 6,053,284 | A * | 4/2000 | Fountain | E06C 7/423 | 182/180.2 |
| 6,089,350 | A * | 7/2000 | Hankins | E06C 7/46 | 182/107 |
| 6,533,071 | B1 * | 3/2003 | Smith | E06C 7/423 | 182/165 |
| 6,883,642 | B2 * | 4/2005 | Matty | E04G 1/20 | 182/107 |
| 7,093,689 | B2 * | 8/2006 | Poldmaa | E06C 1/34 | 182/107 |
| 7,163,084 | B1 * | 1/2007 | Blehm | E06C 7/423 | 182/172 |
| 7,377,360 | B1 * | 5/2008 | Misiak | E06C 7/48 | 182/107 |
| 8,424,642 | B2 * | 4/2013 | Lietz | E06C 1/06 | 182/172 |
| 8,752,672 | B2 * | 6/2014 | Turner | E06C 7/48 | 182/107 |
| 2004/0089501 | A1 * | 5/2004 | Hockensmith | E06C 7/48 | 182/107 |
| 2007/0289812 | A1 * | 12/2007 | Feemster | E06C 7/46 | 182/107 |
| 2010/0051384 | A1 * | 3/2010 | Currie | E06C 7/46 | 182/107 |
| 2011/0315476 | A1 * | 12/2011 | Clarkson | E06C 7/48 | 182/107 |

* cited by examiner

LADDER SUPPORT

RELATED PATENT APPLICATIONS

This application is a divisional of U.S. patent application Ser. No. 13/969,509 filed on Aug. 17, 2013, by Donald Alan Graham, SR. of Northglenn, Colo., US.

TECHNICAL FIELD

The present invention relates generally to a support for helping to retain a ladder to a surface. More specifically, the present invention relates to the field of roof to roof ladder supports, in having the ladder support help secure a base portion of the ladder to a lower roof surface to assist in keeping the ladder base portion in a fixed position upon the lower roof for the user to safely climb to the next higher roof.

BACKGROUND OF INVENTION

Ladder related accidents of a user falling from the ladder typically result in serious injury, wherein serious injury happens in just over half (about 51%) the ladder accidents based on overall ladder injury statistics for the United States. In addition, in higher buildings with steeper pitched roofs the serious injury rate from ladder accidents increases to significantly over half (to about 69%), thus placing the upmost importance on ladder safety for users, as there is really not such a thing as a minor ladder accident, in fact according to the Occupational Safety and Health Administration (OSHA) the leading cause of workplace deaths are construction related falls of which ladders were involved most of the time.

Overall, based on a recent Consumer Product Safety Commission (CPSC) ladder safety study, ladder related deaths and injuries accounted for almost 700 deaths annually, wherein ladder accidents have increased over 50% in the last decade due mostly to user neglect and negligence in four major areas being; (1) selecting the wrong ladder for the job, (2) using worn or damaged ladders, (3) incorrect use of ladders, and (4) incorrect placement of ladders. It is item (4), the incorrect placement of ladders that the present invention is concerned with, via controlling the base portion positioning of the ladder, as in most cases relying upon surface friction only as between the ladder base portion feet and the ground surface is risky at best. Further, from the CPSC data, the number one cause of ladder accidents at 40% was that the "ladder moved" followed by foot slip at 24%, and lost balance at 18%, after which no other cause of a ladder accident is greater than 4%, resulting that these first three causes of ladder accidents are the most important, thus the most important safety item to remedy is the "ladder moving" cause, which as referenced above alludes to using ladder foot to ground surface friction is a major risk.

The present invention is focused upon the "ladder moved" cause as being the most significant cause of ladder accidents, and specifically focusing on the roof to roof use of a ladder, wherein the ladder feet are on a lower roof with the ladder leaning against an upper roof margin or edge. Thus for the present invention, a special interface is needed to be developed to help secure the ladder foot to the lower roof, as opposed to penetrable ground anchors, also for the securing of the ladder foot to the lower roof, it is highly desirable to not have a permanently attached support due to the time and cost of installing a permanent support plus the maintenance risk of creating an opening in the roof that can become a future leak point from rain and snow.

In looking at the prior art in U.S. Pat. No. 6,089,350 to Hankins, disclosed is a ladder apparatus for anchoring an upright inclined ladder to the ground for preventing movement of the ladder away from a building structure wall, see FIG. 7, wherein an anchor is typically inserted into the ground, again see FIG. 7. The ladder apparatus in Hankins further hooks around the lowest rung of the ladder and the anchor is in the form of a wedge shaped portion that penetrates the ground between the ladder and the building structure wall that the ladder rests against. In Hankins, the anchor is pivotally foldable in relation to a lateral telescoping section that is laterally adjustable in length, further in Hankins the telescoping section diverges into a pair of "U" shaped section hooks that conform around the lowest rung of the ladder being retained via fasteners.

Continuing in the prior art in U.S. Pat. No. 7,093,689 to Poldmaa, disclosed is a ladder support bracket that receives an upper rung of a ladder intended to be placed against the gutter of a building roof and thus restraining the upper rung of the ladder while at the same time protecting the roof gutter from damage due to the ladder upper rung and to an upper portion of the ladder, see FIGS. 1 and 2. Further, in Poldmaa the ladder support bracket prevents the ladder from having lateral or downward movement along the gutter of the roof. The bracket in Poldmaa includes a first region for permanently affixing to a rigid portion of the building being most notably an area of the building roof adjacent to the roof gutter, a second region which spans the gutter, and a third region in the form of a cradle for receiving the rung of the ladder, see FIG. 2.

The ladder support bracket in Poldmaa preferably has the first region for fixing the bracket to a rigid portion of the building in the form of a relatively planar sheet like bracket which may be attached by suitable fasteners 22, such as screws or the like, to the rafters or other timber members of the roof support structure of the building, such as battens, this portion of the roof then being covered by the roofing material, whether tiles or metal roofing, again see FIG. 2. Note, that the Poldmaa bracket is permanently affixed to the house roof and provides a gutter based support for a ground based ladder with the purpose being primarily to protect the gutter from the ladder "lean to" loading and to help secure the ladder laterally further as there is no teaching in Poldmaa related to ladder base support.

Further, in the prior art in looking at United States Patent Application Publication Number 2010/0051384 to Currie, disclosed is a ladder stabilizer for securing a ladder to a penetrable ground surface. The stabilizer in Currie comprises of a rung holder channel and a substantially flat "tent type" spike having a pointed end for insertion into the ground. The spike in Currie is connected to the rung holder channel and extends towards the ground effectively "clamping down" on the bottom ladder rung. The rung holder channel in Currie is a substantially rectangular part with open bottom to receive a ladder rung, which engages with the bottom rung of the ladder once the spike is forced into the ground with a foot support attachment which is rigidly fixed to the body of the rung holder. Note that in Currie, which is essentially the Hankins invention without the telescoping section, if the ladder feet were to sink into soft ground that the bottom rung would disengage from the channel via movement downward thus rendering the ladder stabilizer ineffective.

Continuing in the prior art in U.S. Pat. No. 5,890,560 to Sloop disclosed is a ladder stabilizing device that is adapted for attachment to a ladder and to a fixed structure, i.e. see pole in FIG. 1, for holding the ladder in a stable condition on a supporting surface adjacent to the structure preferably in the form of a pole, wherein the ladder stabilizing device is in tension only as between the ladder and the pole, see element 26 being a strap as shown in FIG. 1. In Sloop, the ladder includes a base, a pair of laterally spaced side rails, and a plurality of vertically spaced and laterally extending rungs connected to the side rails. The ladder stabilizing device in Sloop includes an elongate ladder locking member with a pair of spaced-apart locking grips for being releasably locked in laterally spaced relation onto one of the rungs of the ladder. An elongate attachment member in Sloop is rigidly coupled at a first end with the ladder locking member and the opposite second end of the attachment member is adapted for being secured to the fixed structure or pole.

A releasable fastener in Sloop is located at the second end of the attachment member for releasably attaching the stabilizing device to the fixed structure or pole. In Sloop, the fastener and locking grips cooperate to resist pivoting movement of the ladder about either of the side rails from the bifurcated structure at 34A and 35A, see FIG. 3, and to maintain the base of the ladder in a fixed and stable position on the supporting surface. Note that in Sloop, if the ladder feet were to sink into soft ground that the ladder stabilizing device would slacken from its tension state, thus rendering the ladder stabilizer ineffective, especially in the area of unstable ladder pivotal movement along its long axis, as there is no stability effect (i.e. fighting the pivotal movement) from the pole like there would be from the ladder leaning as against a conventional flat surface structure.

Further in the prior art, in U.S. Pat. No. 7,743,886 to Feemster, Jr., et al., disclosed is a representative system that incorporates a ladder stabilizing assembly that includes a mount, a frame, and a spike, being somewhat similar to Currie. The mount in Feemster is configured to attach to a ladder rung and the ground surface. The frame in Feemster extends from the mount and is movable between a stowed position for transporting the ladder, in which the frame is located adjacent the ladder, and an un-stowed position, in which the frame extends outwardly from the ladder.

The spike in Feemster extends from the frame and is operative to be driven into the ground such that, when the frame is in the un-stowed position and the spike is driven into the ground, the ladder stabilizing assembly provides support to the ladder as in the same manner as Currie. Note that in Feemster, which also is essentially the Hankins invention without the telescoping section as disclosed in Feemster FIG. 1, if the ladder feet were to sink into soft ground that the bottom rung would disengage from a ladder rung channel mount 115 via ladder movement downward, thus rendering the ladder stabilizer ineffective.

What is needed is a ladder support that can accommodate the special interface that is needed to help secure the ladder foot to the lower roof without a permanent attachment or hole or opening left in the lower roof, as opposed to penetrable ground anchors. Further a ladder support needs to secure of the ladder foot to the lower roof, all in a manner that is lightweight, portable, and easy to install and uninstall.

SUMMARY OF INVENTION

Broadly, the present invention is a ladder support for use with a ladder, wherein the ladder includes a pair of rails each having a base end portion and an opposing free end portion, with the pair of rails having a plurality of perpendicularly positioned rungs disposed therebetween that are spaced apart from one another. Further the ladder support is for use therebetween an upper roof and a lower roof with a gutter, wherein the free end portion of the rails is resting against the upper roof and the base end portion of the rails is resting against the lower roof surface.

The ladder support includes an extension strut including a first end portion and an opposing second end portion having a longitudinal axis spanning therebetween, also included is a channel shaped cross piece structure having a longwise axis, the channel shaped cross piece structure having an open end and an opposite closed end on each side of the longwise axis. Wherein the channel shaped cross piece structure is attached to the extension strut second end portion being positioned such that said longwise axis is substantially perpendicular to the longitudinal axis, wherein the channel shaped cross piece structure is operative to receive one the ladder rungs through the open end and with the ladder rung resting against the closed end.

Further the ladder support includes an angle beam having a lengthwise axis, the angle beam including a primary leg portion and a secondary leg portion, the primary leg portion is attached to the extension strut first end portion being positioned such that the lengthwise axis is substantially perpendicular to the longitudinal axis with the secondary leg portion extending away from the extension strut first end portion. Wherein the secondary leg portion is operative to be disposed within the gutter, wherein operationally the ladder support helps to secure the ladder rail base end portions at a selected position upon the lower roof surface resulting in the ladder having a more secured position as between the lower roof and the upper roof.

These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 1:
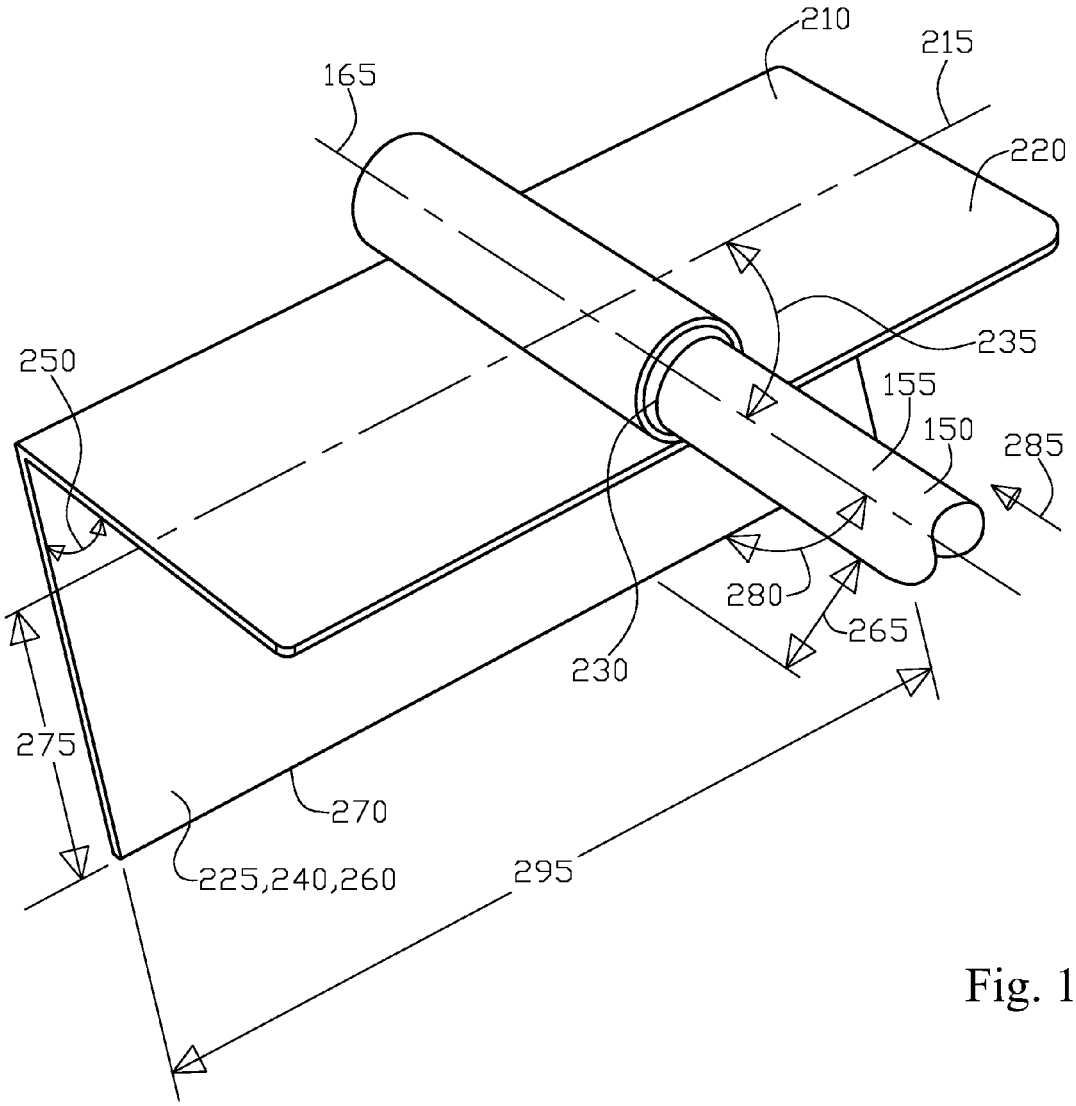
FIG. 1 shows an expanded perspective view of an extension strut, a longitudinal axis of the strut, in particular with the first end portion of the strut, an angle beam including a primary leg portion, a secondary leg portion, a lengthwise axis of the angle beam, also shown are an attachment of the primary leg portion to the strut first end portion, an angle beam secondary leg margin, a straight edge, the perpendicular relationship of the lengthwise axis and the longitudinal axis, the perpendicular relationship of the primary leg portion and the secondary leg portion, a parallel relationship of the straight edge and the lengthwise axis, a maximum distance as between the extension strut and the straight edge, and a length of the straight edge.

50 Ladder support assembly
55 Ladder
60 Rails for the ladder 55
65 Base end portion of the rails 60
70 Base end portion resting on the lower roof 100 at a selected position
75 Free end portion of the rails 60
80 Free end portion of the rails 60 resting against the upper roof 95
85 Rungs of the ladder 55
90 Perpendicular positioning on the ladder rungs 85 to the rails 60
95 Upper roof
100 Lower roof
105 Gutter
110 Floor portion of gutter 105
115 Proximal sidewall of gutter 105
120 Attachment to the lower roof 100 of the proximal sidewall 115
125 Opposing side of the floor portion 110
130 Distal sidewall of the gutter 105
135 "U" type cross section of the gutter 105
140 Interface of the floor portion 110 and the distal sidewall 130 of the gutter 105
145 Width of gutter 105
150 Extension strut
155 First end portion of the extension strut 150

160 Second end portion of the extension strut 150
165 Longitudinal axis of the extension strut 150
170 Channel shaped cross piece structure
175 Longwise axis of the channel 170
180 Open end of the channel 170
185 Closed end of the channel 170
190 Attachment of the channel 170 to the extension strut 150 second end portion 160
195 Substantially perpendicular orientation of the longwise axis 175 and the longitudinal axis 165
200 Receiving the ladder rung 85 through the open end 180 of the channel 170
205 Resting of the ladder rung 85 against the closed end 185
210 Angle beam
215 Lengthwise axis of the angle beam 210
220 Primary leg portion of the angle beam 210
225 Secondary leg portion of the angle beam 210
230 Attachment of the primary leg portion 220 to the extension strut 150 first end portion 155
235 Substantially perpendicular orientation of the lengthwise axis 215 to the longitudinal axis 165
240 Secondary leg portion 225 extending away from the extension strut 150 first end portion 155
245 Secondary leg portion 225 disposed within the gutter 105
250 Perpendicular orientation as between angle beam 210 primary leg portion 220 and the angle beam 210 secondary leg portion 225 about the lengthwise axis 215
260 Secondary leg margin of the secondary leg portion 225
265 Maximum distance as between extension strut 150 first end portion 155 to the secondary leg margin 260
270 Straight edge of the secondary leg margin 260
275 Parallel relationship between the lengthwise axis 215 and the straight edge 270
280 Perpendicular relationship between the longitudinal axis 165 and the straight edge 270
285 Force along the longitudinal axis 165 toward the extension strut 150 first end portion 155
290 Distribution of the force 285 within the gutter 105 via the secondary leg portion 245, the secondary leg margin 260, and the straight edge 270 to reduce area loading on the gutter interface 140
295 Length of the straight edge 270 that is parallel to the lengthwise axis 215
300 Length of the channel shaped cross piece structure 170 that is parallel to the longwise axis 175
305 Platform extension
310 Platform extension 305 positioned opposite of the angle beam 210 secondary leg portion 225 in relation to the extension strut 150
315 Angle of the platform extension 310 to narrow the channel 170 open end 180
316 User
320 User stepping on of the platform extension 305
325 Pivotal movement of the extension strut 150 from the user 316 stepping on the platform extension 305
330 Distance as between the gutter 105 and the ladder rails base 65
335 Strut length
340 Means for selectively adjusting and locking a strut length 335
345 Telescoping section of the means 340
350 Apertures of the means 340
355 Pin of the means 340 wherein the pin 355 is removably engagable
360 Positioning the angle beam 210 secondary leg portion 225 within the gutter 105
365 The extension strut 150 resting upon the lower roof 100
370 Raising the channel shaped cross piece structure 170
375 Even position of the channel shaped cross piece structure 170 with the ladder 55 rung 85
380 Moving the ladder 55 so that the rung 85 is received into the channel 170 open end 180 and rests against the closed end 185
385 Adjusting the strut length 335
390 Dislodging the pin 355 from the aperture 350 to adjust the strut length 335
395 Inserting the pin 355 into the aperture 350 to lock the strut length 335
400 Aligning and nesting the secondary leg margin 260 straight edge 270 into the interface 140 between the gutter 105 floor portion 110 and the gutter 105 distal sidewall 130

DETAILED DESCRIPTION

With initial reference to FIG. 1 shown is an expanded perspective view of an extension strut 150, a longitudinal axis 165 of the strut 150, in particular with the first end portion 155 of the strut 150, an angle beam 210 including a primary leg portion 220, a secondary leg portion 225, a lengthwise axis 215 of the angle beam 210, also shown are an attachment 230 of the primary leg portion 220 to the strut 150 first end portion 155. Continuing, FIG. 1 shows an angle beam 210 secondary leg margin 260, a straight edge 270, the perpendicular relationship 235 of the lengthwise axis 215 and the longitudinal axis 165, the perpendicular relationship 250 of the primary leg portion 220 and the secondary leg portion 225, a parallel relationship 275 of the straight edge 270 and the lengthwise axis 215, a maximum distance 265 as between the extension strut 150 and the straight edge 270 of the secondary leg margin 260, and a length 295 of the straight edge 270.

Figure 2:
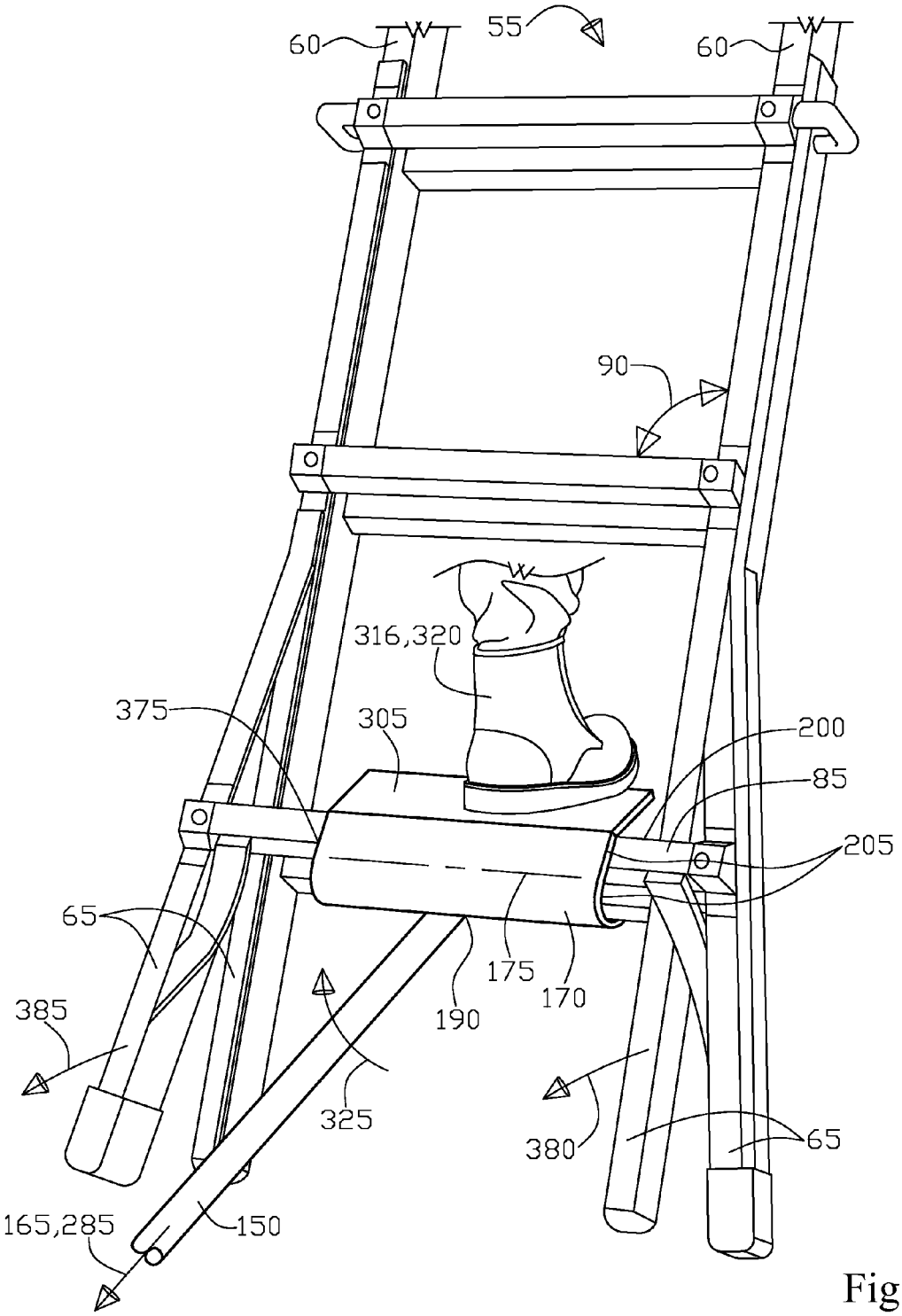
FIG. 2 shows an expanded perspective view of the extension strut on a second end portion with the longitudinal axis, a channel shaped cross piece structure, a longwise axis of the channel, an open end of the channel, a closed end of the channel, an attachment of the channel to the extension strut, also a ladder, rails for the ladder, a base end portion of the rails, rungs of the ladder, a perpendicular orientation of the ladder rungs to the rails, further the rung being received into the channel via the open end and closed end of the channel, in addition a platform extension of the channel, and a user stepping on the platform extension.

Next, FIG. 2 shows an expanded perspective view of the extension strut 150 on a second end portion 160 with the longitudinal axis 165, a channel shaped cross piece structure 170, a longwise axis 175 of the channel 170, an open end 180 of the channel 170, a closed end 185 of the channel 170, an attachment 190 of the channel 170 to the extension strut 150. Further, FIG. 2 shows a ladder 55, rails 60 for the ladder 55, a base end portion 65 of the rails 60, rungs 85 of the ladder 55, a perpendicular orientation 90 of the ladder 55 rungs 85 to the rails 60, also the rung 85 being received 200 into the channel 170 via the open end 180 and closed end 185 of the channel 170, in addition a platform extension 305 of the channel 170, and a user 316 stepping 320 on the platform extension 305.

Figure 3:
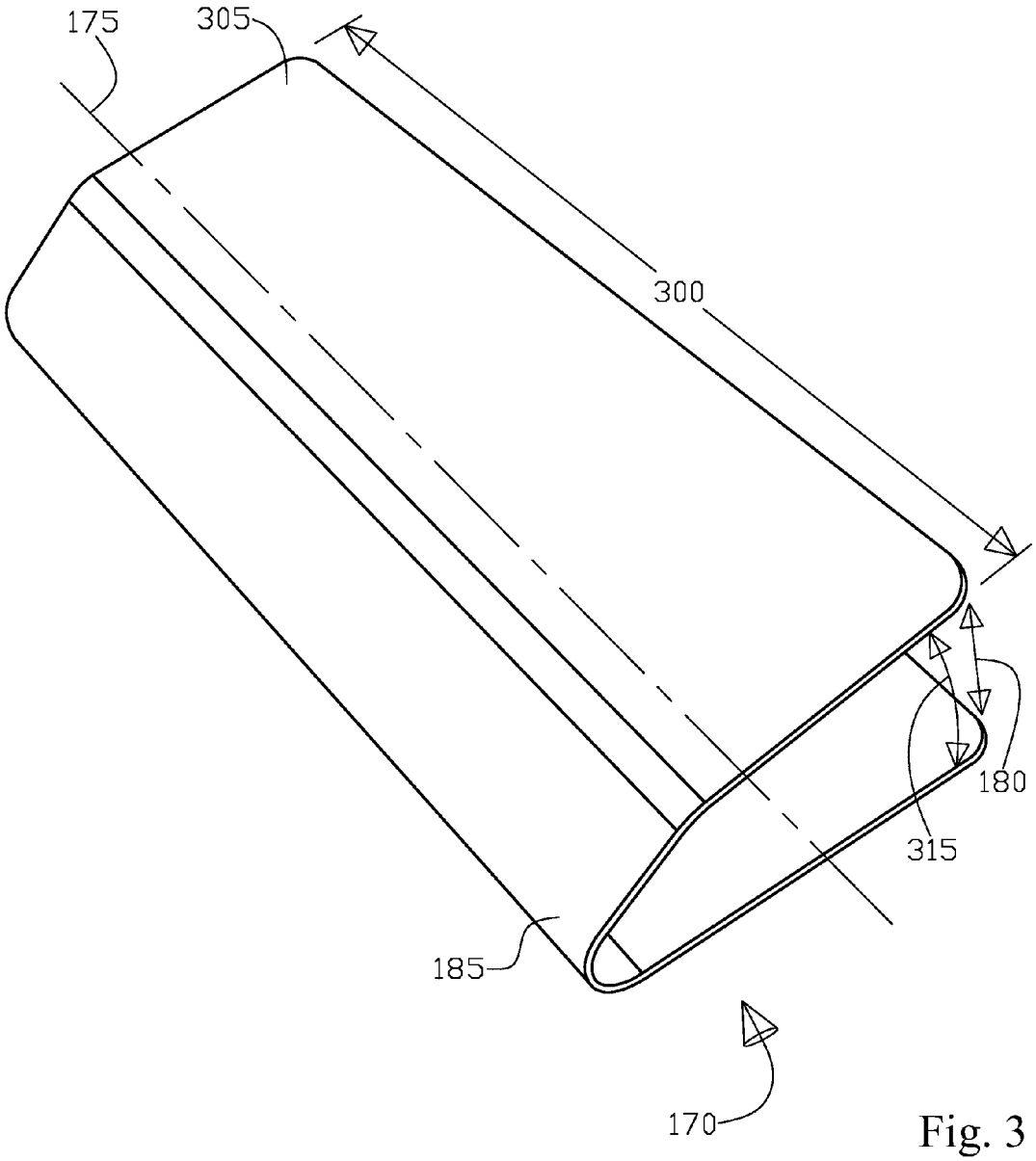
FIG. 3 shows a perspective view of the channel shaped cross piece structure, the longwise axis of the channel, the open end of the channel, the closed end of the channel, the platform extension of the channel, a length of the channel, and an angle of the platform extension to narrow the channel open end.

Continuing, FIG. 3 shows a perspective view of the channel shaped cross piece structure 170, the longwise axis 175 of the channel 170, the open end 180 of the channel 170, the closed end 185 of the channel 170, the platform extension 305 of the channel 170, a length 300 of the channel 170, and an angle 315 of the platform extension 305 to narrow the channel 170 open end 180.

Figure 4:
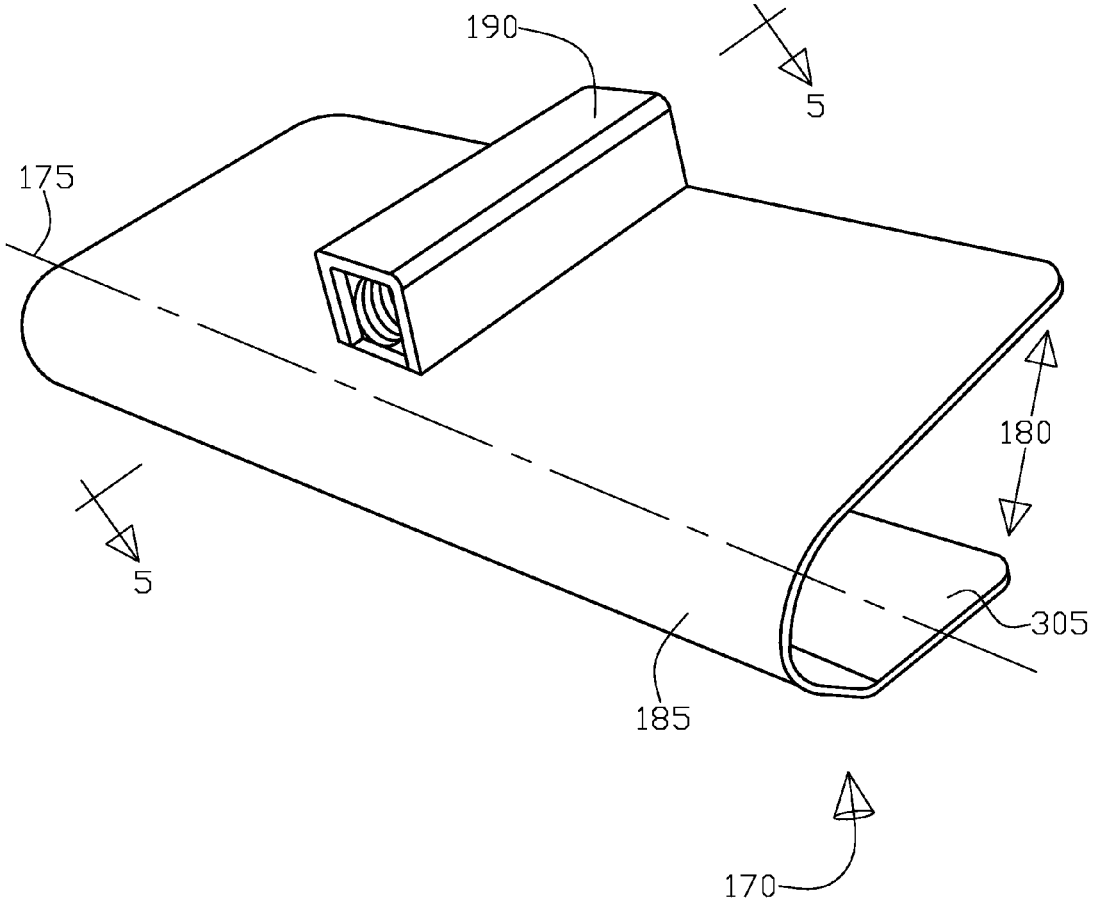
FIG. 4 shows an opposing side perspective view of the channel shaped cross piece structure, the longwise axis of the channel, the open end of the channel, the closed end of the channel, the platform extension of the channel, and the attachment of the channel for the extension strut (not shown)

Moving onward, FIG. 4 shows an opposing side perspective view of the channel shaped cross piece structure 170, the longwise axis 175 of the channel 170, the open end 180 of the channel 170, the closed end 185 of the channel 170, the platform extension 305 of the channel 170, and the attachment 190 of the channel 170 for the extension strut 150 (not shown).

Figure 5:
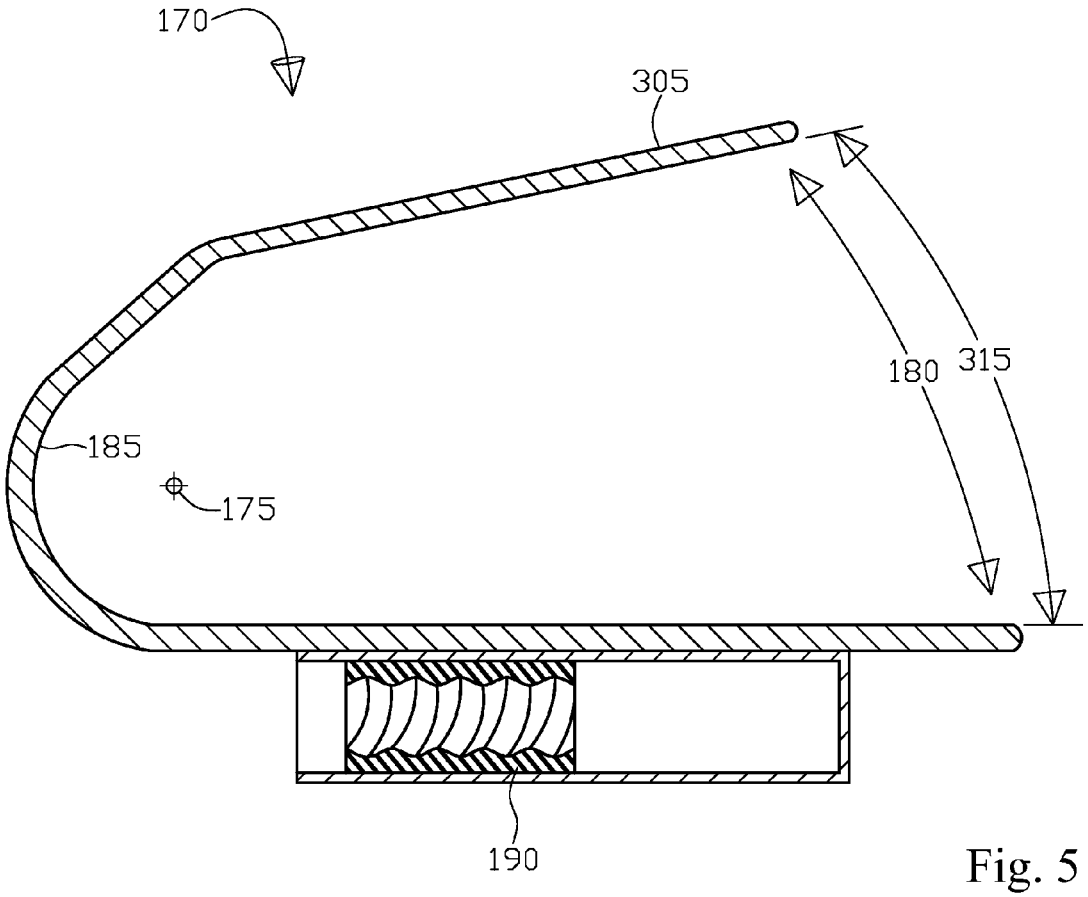
FIG. 5 shows cross section view 5-5 inverted from FIG. 4, with the channel shaped cross piece structure, the longwise axis of the channel, the open end of the channel, the closed end of the channel, the platform extension of the channel, and the attachment of the channel for the extension strut (not shown)

Next, FIG. 5 shows cross section view 5-5 inverted from FIG. 4, with the channel shaped cross piece structure 170, the longwise axis 175 of the channel 170, the open end 180 of the channel 170, the closed end 185 of the channel 170, the platform extension 305 of the channel 170, and the attachment 190 of the channel 170 for the extension strut 150 (not shown).

Figure 6:
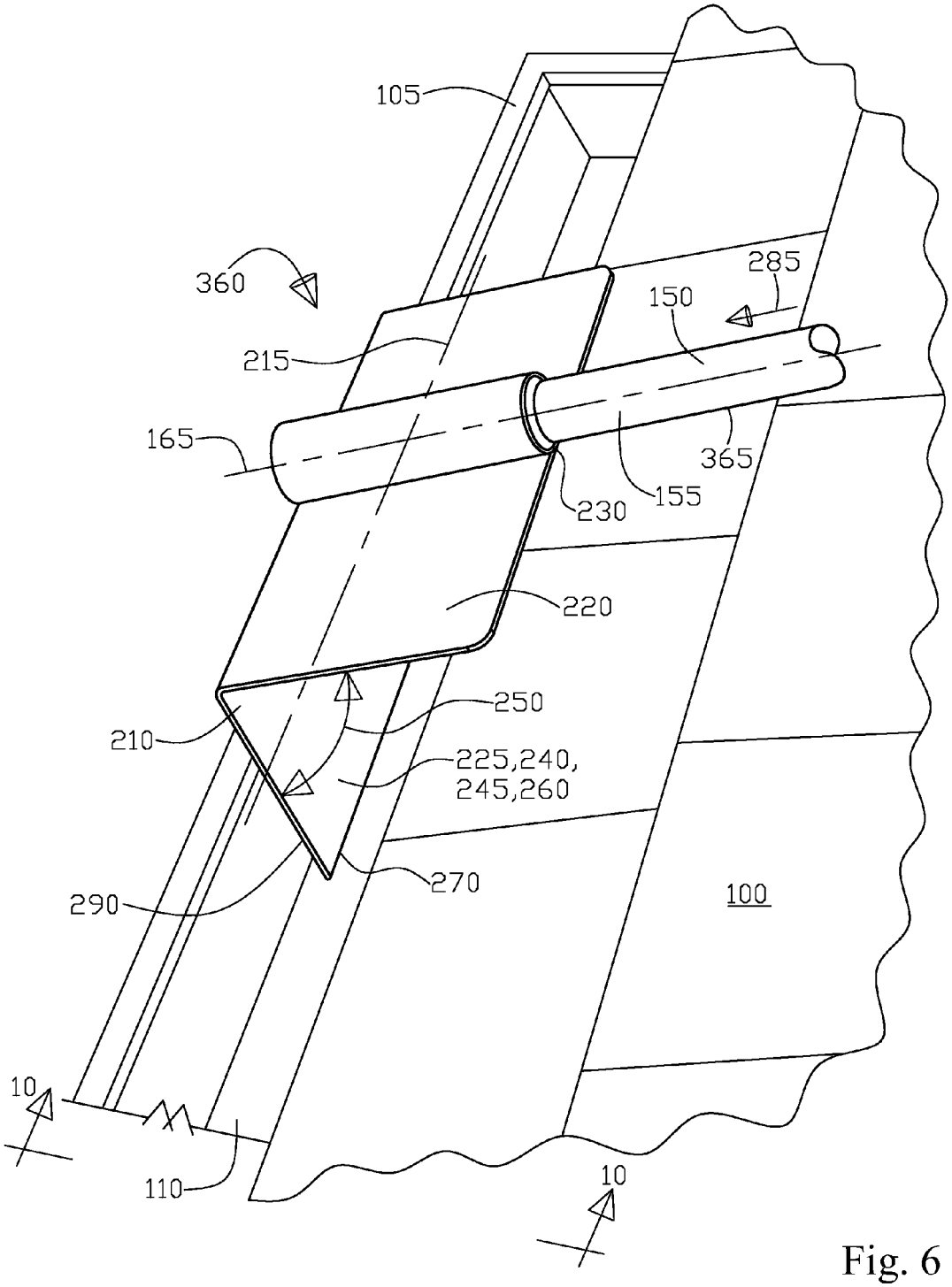
FIG. 6 shows an expanded perspective view of the extension strut, in particular with the first end portion of the strut with the longitudinal axis of the strut, the angle beam including the primary leg portion, the secondary leg portion, the secondary leg portion extending away from strut first end portion, the lengthwise axis of the angle beam, also shown is the attachment of the primary leg portion to the strut first end portion, the angle beam secondary leg margin, the straight edge, the perpendicular relationship of the primary leg portion and the secondary leg portion, with the angle beam being disposed within a gutter that has a gutter floor portion shown, also the angle beam secondary leg portion and margin is shown disposed within the gutter, also indicated is the force along the longitudinal axis toward the extension strut first end portion from the ladder (not shown) and the distribution of the force within the gutter via the secondary leg portion, the margin, and the straight edge via positioning the angle beam secondary leg portion within the gutter.

Next, FIG. 6 shows an expanded perspective view of the extension strut 150, in particular with the first end portion 155 of the strut 150 with the longitudinal axis 165 of the strut 150, the angle beam 210 including the primary leg portion 220, the secondary leg portion 225, the secondary leg portion 225 extending away 240 from strut 150 first end portion 155, the lengthwise axis 215 of the angle beam 210. Also shown in FIG. 6 is the attachment 230 of the primary leg portion 220 to the strut 150 first end portion 155, the angle beam 210 secondary leg margin 225, the straight edge 270, the perpendicular relationship 250 of the primary leg portion 220 and the secondary leg portion 225, with the angle beam 210 being disposed 245 within a gutter 105 that has a gutter floor portion 110 shown, also the angle beam 210 secondary leg portion 225 and margin 260 is shown disposed 245 within the gutter 105. In addition, FIG. 6 shows the force 285 along the longitudinal axis 165 toward the extension strut 150 first end portion 155 from the ladder 55 (not shown) and the distribution 290 of the force 285 within the gutter 105 via the secondary leg portion 225, margin 260, and straight 270 edge via positioning 360 the angle beam 210 secondary leg portion 225 within the gutter 105.

Figure 7:
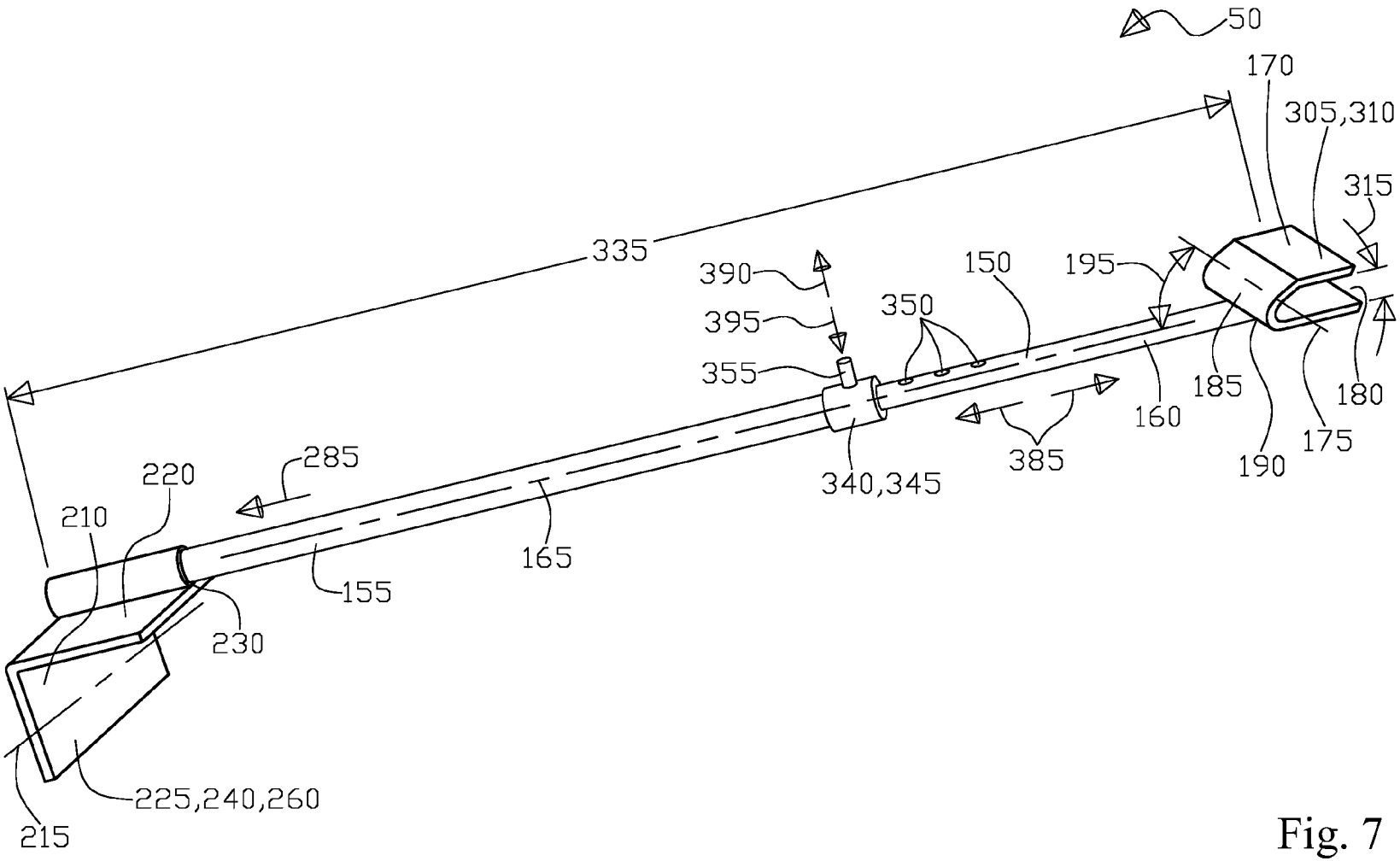
FIG. 7 shows a side elevation view of the entire ladder support assembly starting with the angle beam, the lengthwise axis of the angle beam, the primary and secondary leg portions of the angle beam, the secondary leg portion extending away from the strut first end portion, the secondary leg margin, the attachment of the primary leg portion to the extension strut first end portion, also the extension strut, the longitudinal axis, the force from the ladder (not shown), a means for selectively adjusting and locking a strut length, also the preferred means of a telescoping section, apertures, and pin, further an adjusting of the strut length, plus dislodging the pin from the aperture and inserting the pin into the aperture, also shown is a second end portion of the strut, the channel, the longwise axis of the channel, an attachment of the channel to the extension strut second end portion, the platform extension, the platform extension positioning opposite of the angle beam secondary leg portion relative to the extension strut, and the angle of the platform extension to narrow the channel open end.

Further, FIG. 7 shows a side elevation view of the entire ladder support assembly 50 starting with the angle beam 210, the lengthwise axis 215 of the angle beam 210, the primary 220 and secondary 225 leg portions of the angle beam 210, the secondary leg portion 225 extending away 240 from the strut 150 first end portion 155, the secondary leg margin 260, the attachment 230 of the primary leg portion 220 to the extension strut 150 first end portion 155. Also, shown in FIG. 7 is the extension strut 150, the longitudinal axis 165, the force 285 from the ladder 55 (not shown), a means 340 for selectively adjusting 385 and locking 395 a strut length 335, also it is preferred for the means 340 to have a telescoping section 345, apertures 350, and pin 355, further an adjusting 385 of the strut 150 length 335, plus dislodging 390 the pin 355 from the aperture 350 and inserting 395 the pin 355 into the aperture 350. In addition, shown in FIG. 7 is a second end portion 160 of the strut 150, the channel 170, the longwise axis 175 of the channel 170, an attachment 190 of the channel 170 to the extension strut 150 second end portion 160, the platform extension 305, the platform extension 305 positioning 310 opposite of the angle beam 210 secondary leg portion 225 relative to the extension strut 150, and the angle 315 of the platform extension 305 to narrow the channel open end 180.

Figure 8:
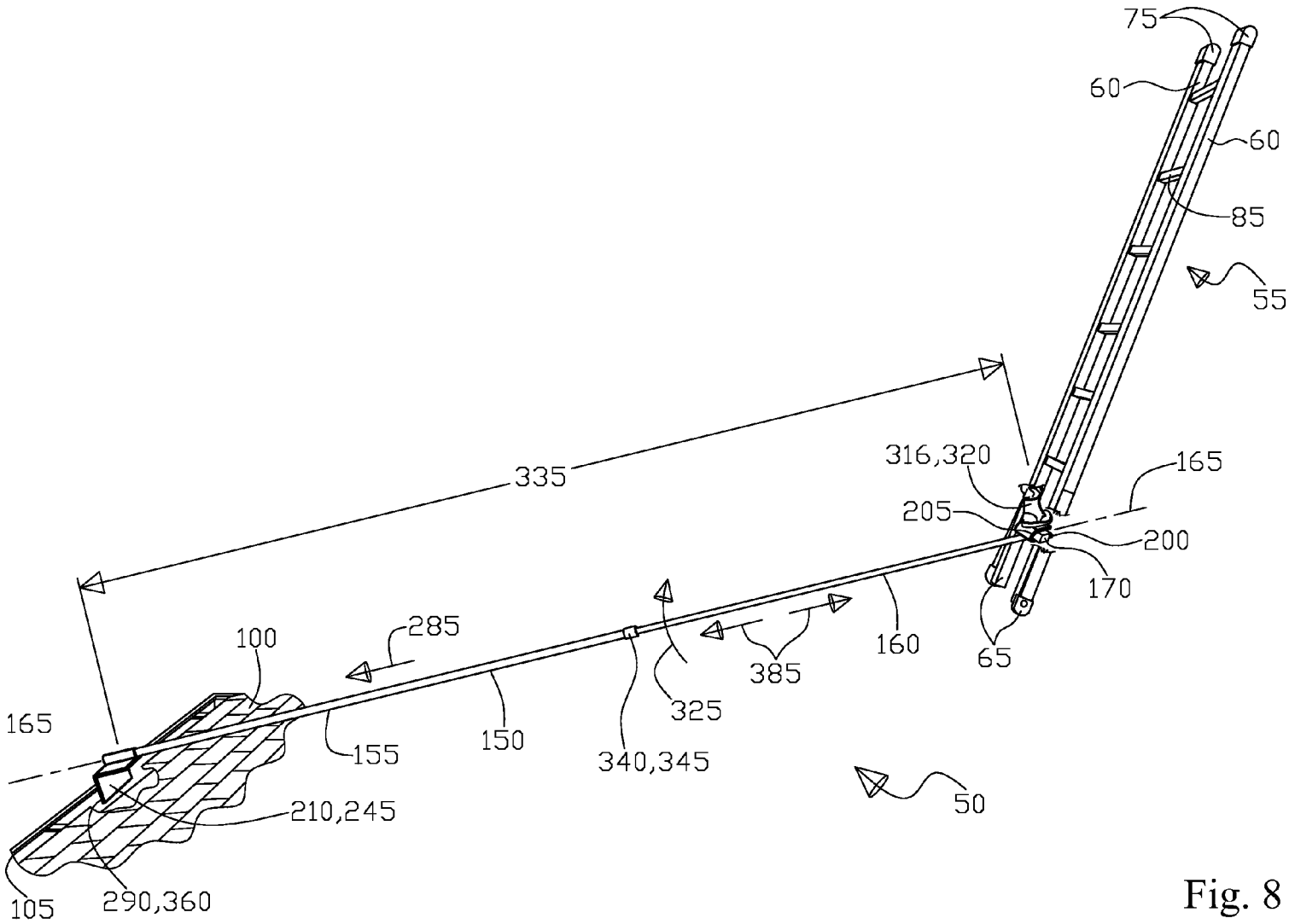
FIG. 8 shows a side elevation view of the entire ladder support assembly installed and in use with the lower roof and gutter (the upper roof is removed for pictorial clarity), starting with the angle beam, the secondary leg portion of the angle beam, the distribution of the force within the gutter via the secondary leg portion, margin, and straight edge, further shown is positioning the angle beam, secondary leg portion within the gutter, the extension strut with the first end portion and the second end portion, the means for selectively adjusting and locking a strut length to accommodate a varying distance as between the gutter and the ladder rails base, the channel wherein the ladder rung is received through the open end of the channel and rests against the closed end of the channel, further a user is shown stepping on the platform extension which is to help prevent pivotal movement of the extension strut which can dislodge the angle beam from the gutter.

Continuing, FIG. 8 shows a side elevation view of the entire ladder support assembly 50 installed and in use with the lower roof 100 and gutter 105 (the upper roof 95 is removed for pictorial clarity), starting with the angle beam 210, the secondary leg portion 225 of the angle beam 210, the distribution 290 of the force 285 within the gutter 105 via the secondary leg portion 225, margin 260, and straight edge 270. Further shown in FIG. 8 is positioning 360 the angle beam 210 and secondary leg portion 225 within the gutter 105, the extension strut 105 with the first end portion 155 and the second end portion 160, the means 340 for selectively adjusting 385 and locking 395 a strut 105 length 335 to accommodate a varying distance 330 as between the gutter 105 and the ladder rails base 65. Also, shown in FIG. 8 is the channel 170 wherein the ladder rung 85 is received 200 through the open end 180 of the channel 170 and rests 205 against the closed end 185 of the channel 170, further a user 316 is shown stepping 320 on the platform extension 305 which is to help prevent pivotal movement 325 of the extension strut 105 which can dislodge the angle beam 210 from the gutter 105.

Figure 9:
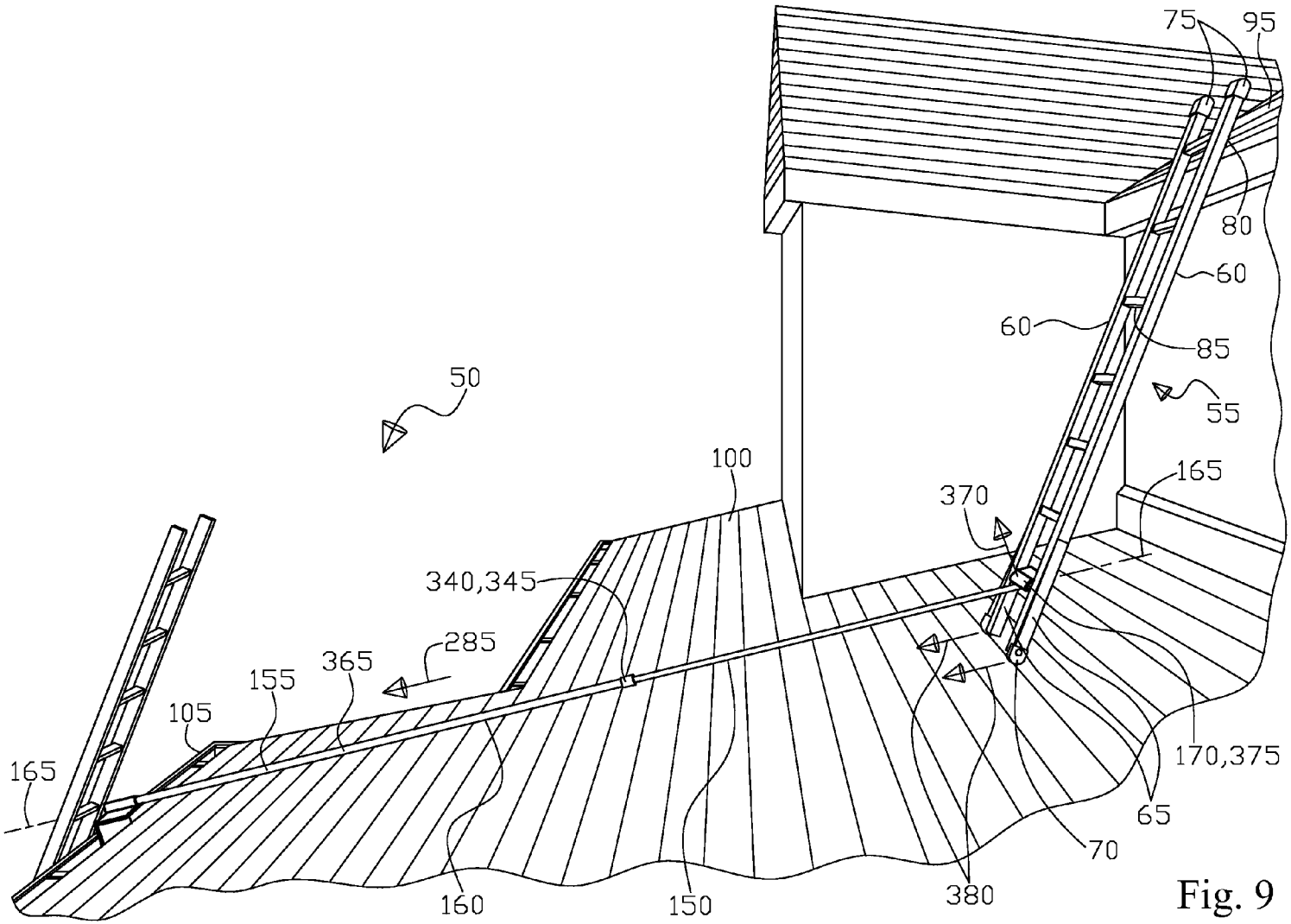
FIG. 9 shows a side elevation view of the entire ladder support assembly installed and in use with the lower roof and gutter and the upper roof, the extension strut with the first end portion and the second end portion, the means for selectively adjusting and locking a strut length to accommodate a varying distance as between the gutter and the ladder rails base, the channel wherein the ladder rung is received through the open end of the channel and rests against the closed end of the channel, and the ladder with the rails having the rail base end portions resting on the lower roof in a selected position, a free end portion of the rails, with the rail free end portions resting on the upper roof, also the ladder rungs, also raising the channel to align evenly with the ladder rung, and showing the moving of the ladder so that the rung is received into the channel open end and with the rung resting against the channel closed end.

Next, FIG. 9 shows a side elevation view of the entire ladder support assembly 50 installed and in use with the lower roof 100, gutter 105 and the upper roof 95, the extension strut 150 with the first end portion 155 and the second end portion 160, the means 340 for selectively adjusting 385 and locking 395 a strut 150 length 335 to accommodate a varying distance 330 as between the gutter 105 and the ladder rails base 65. Further shown in FIG. 9 is the channel 170 wherein the ladder rung 85 is received 200 through the open end 180 of the channel 170 and rests 205 against the closed end 185 of the channel 170, and the ladder 55 with the rails 60 having the rail base end portions 65 resting 70 on the lower roof 100 in a selected position, a free end portion 75 of the rails 60, with the rail free end portions 75 resting 80 on the upper roof 95, also the ladder 55 rungs 85. Also FIG. 9 shows raising 370 the channel 170 to align evenly 375 with the ladder rung 85, and showing the moving 380 the ladder 55 so that the rung 85 is received 200 into the channel 170 open end 180 and with the rung 85 resting 205 against the closed end 185.

Figure 10:
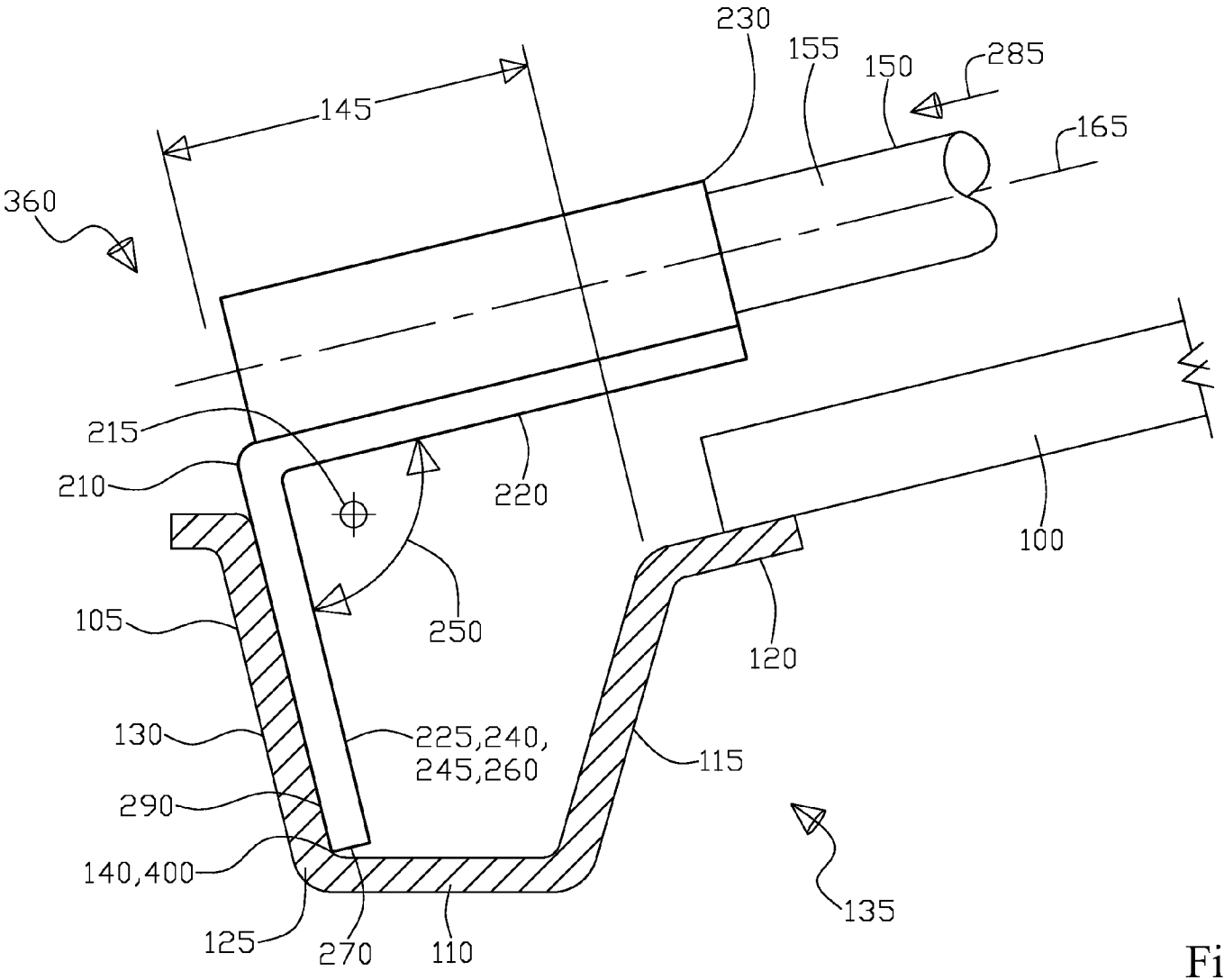
FIG. 10 shows view 10-10 from FIG. 6, giving detail of the angle beam and gutter interface, showing the lower roof, the gutter, the floor portion of the gutter, a proximal sidewall of the gutter, attachment of the lower roof to the gutter proximal sidewall, an opposing side of the gutter floor portion, a distal sidewall of the gutter, a "U" type cross section of the gutter, an interface of the gutter floor portion and the distal sidewall, width of the gutter, wherein the angle beam with its primary leg portion and secondary leg portion, margin, and straight edge, and further the extension strut first end portion and the attachment of the strut first end portion to the primary leg portion, also the force along the longitudinal axis of the strut wherein the force is distributed within the gutter via the secondary leg portion, the margin, and the straight edge, positioning the angle beam secondary leg portion within the gutter, and aligning and nesting the secondary leg margin and straight edge into the interface between the gutter floor portion and gutter distal sidewall.

Continuing, FIG. 10 shows view 10-10 from FIG. 6, giving detail of the angle beam 210 and gutter 105 interface 140, showing the lower roof 100, the gutter 105, the floor portion 110 of the gutter 105, a proximal sidewall 115 of the gutter 105, attachment 120 of the lower roof 100 to the gutter 105 proximal sidewall 115, an opposing side 125 of the gutter floor portion 110, a distal sidewall 130 of the gutter 105, a "U" type cross section 135 of the gutter 105, an interface 140 of the gutter 105 floor portion 110 and the distal sidewall 130, and width 145 of the gutter 105. Further shown in FIG. 10 is the angle beam 210 with its primary leg portion 220 and secondary leg portion 225, margin 260, and straight edge 270, and further the extension 150 strut first end portion 155 and the attachment 230 of the strut 150 first end portion 155 to the primary leg portion 220, also the force 285 along the longitudinal axis 165 of the strut 150 wherein the force 285 is distributed 290 within the gutter 105 via the secondary leg portion 225, the margin 260, and the straight edge 270, positioning 360 the angle beam 210 secondary leg portion 225 within the gutter 105, and aligning and nesting 400 the secondary leg margin 225 and straight edge 270 into the interface 140 between the gutter floor portion 110 and gutter distal sidewall 130.

With initial reference to FIGS. 7 through 9, a ladder support 50 for use with a ladder 55 in shown, wherein the ladder 55 includes a pair of rails 60 each having a base end portion 65 and an opposing free end portion 75, with the pair of rails 60 having a plurality of perpendicularly positioned rungs 85 disposed therebetween that are spaced apart from one another, see also FIG. 2. Further the ladder support 50 is for use therebetween an upper roof 95 and a lower roof 100 with a gutter 105, see FIGS. 8 and 9, wherein the free end portion 75 of the rails 60 is resting 80 against the upper roof 95 and the base end portion 65 of the rails is resting 70 against the lower roof 100, see FIG. 9.

The ladder support 50 includes an extension strut 150 including a first end portion 155 and an opposing second end portion 160 having a longitudinal axis 165 spanning therebetween, also included is a channel shaped cross piece structure 170 having a longwise axis 175, the channel shaped cross piece structure 170 having an open end 180 and an opposite closed end 185 on each side of a longwise axis 175, see FIGS. 1 through 7. Wherein the channel shaped cross piece structure 170 is attached 190 to the extension strut 150 second end portion 160, with the channel 170 being positioned such that the longwise axis 175 is substantially perpendicular 195 to the longitudinal axis 165, wherein the channel shaped cross piece structure 170 is operative to receive one the ladder rungs 85 through the open end 180 and with the ladder rung 85 resting against the closed end 185, see FIGS. 2, 8, and 9.

Further the ladder support 50 includes an angle beam 210 having a lengthwise axis 215, the angle beam 210 including a primary leg portion 220 and a secondary leg portion 225, wherein the primary leg portion 220 is attached 230 to the extension strut 150 first end portion 155 being positioned such that the lengthwise axis 215 is substantially perpendicular 235 to the longitudinal axis 165 with the secondary leg portion 225 extending away 240 from the extension strut 150 first end portion 155, see FIGS. 1, 6, 7, and 10. Wherein the secondary leg portion 225 is operative to be disposed 245 within the gutter 105, wherein operationally the ladder support 50 helps to secure the ladder 55 rail 60 base end portions 65 at a selected position upon the lower roof 100 surface resulting in the ladder 55 having a more secured position as between the lower roof 100 and the upper roof 95, see in particular FIGS. 8 and 9.

Further, on the ladder support 50 the angle beam 210 primary leg portion 220 and the angle beam 210 secondary leg portion 225 are orientated in a perpendicular manner 250 to one another about the lengthwise axis 215, wherein the primary leg portion 220 and the secondary leg portion 225 perpendicular orientation 250 is operational to dispose 245 the secondary leg portion 225 easier within various gutter 105 widths 145, see in particular FIGS. 1, 6, and 10.

In addition, on the ladder support 50 the secondary leg portion 225 can terminate in a secondary leg margin 260 that is positioned a maximum distance 265 away from the extension strut 150 first end portion 155, wherein the secondary leg margin 260 forms a straight edge 270 that is parallel 275 to the lengthwise axis 215 and perpendicular 280 to the longitudinal axis 165, see FIG. 1. Wherein operationally, the secondary leg margin 260 acts to more widely distribute 290 a force 285 along the longitudinal axis 165 toward the extension strut 150 first end portion 155, with the force 285 being from the ladder rung 85 to within the gutter 105 to reduce gutter area loading, see FIGS. 6 through 10.

Continuing, for the ladder support 50 the secondary leg margin 260 straight edge 270 has an angle beam 210 length 295 that is parallel 275 to the lengthwise axis 215 that is greater than a channel shaped cross piece structure 170 length 300 that is parallel to the longwise axis 175 of the channel shaped cross piece structure 170, see FIGS. 1, 3, 6, 7, and 10. Wherein, operationally the secondary leg margin 260 straight edge 270 angle beam 210 length 295 further more widely distributes 290 the force 285 along the longitudinal axis 165 toward the extension strut 150 first end portion 155 within the gutter 105 for a further reduction in gutter 105 area loading distribution 290, see FIGS. 6 and 8 through 10.

Next on the ladder support 50, wherein the channel shaped cross piece structure 170 can further comprise a platform extension 305 that is positioned 310 to be opposite of the angle beam 210 secondary leg portion 225 in relation to the extension strut 150, the platform extension 305 is angled 315 to further narrow the channel 170 closed end 185, see FIGS. 2, 3, 5, and 7. Wherein operationally the platform extension 305 facilitates a user 316 stepping 320 on the platform extension 305 of the channel 170 that has received 200 the ladder rung 85, wherein the platform extension 305 helps prevent an undesirable pivotal movement 325 of the extension strut 150 that could dislodge the angle beam 210 secondary leg portion 225 from the gutter 105 when the user 316 steps 320 on the platform extension 305, see FIGS. 2 and 8.

Continuing, on the ladder support 50 wherein the extension strut 150 can further comprise a means 340 for selectively adjusting 385 and locking 395 a strut 150 length 335, being operational to further accommodate various distances 330 as between the ladder 55 rails 60 base end portions 65 and the gutter 105, see FIGS. 7, 8, and 9.

Further, for the means 340 for selectively adjusting 385 and locking 395 a strut 105 length 335 is preferably constructed of a telescoping section 345 formed as a part of the strut 150 having a plurality of spaced apart apertures 350 along the longitudinal axis 165 that receive a pin 355 being operational to lock 395 a selected strut length 335, see FIGS. 7, 8, and 9.

METHOD OF USE

Referring in particular to FIGS. 2, 6, and 8 through 10, a method is disclosed of using the ladder support assembly 50 with a ladder 55, wherein the ladder 55 includes a pair of rails 60 each having a base end portion 65 and an opposing free end portion 75, with the pair of rails 60 having a plurality of perpendicularly positioned rungs 85 disposed therebetween that are spaced apart from one another, see also FIG. 2. Further, the ladder support 50 is for use therebetween an upper roof 95 and a lower roof 100 with a gutter 105, see FIGS. 8 and 9, wherein the free end portion 75 of the rails 60 is resting 80 against the upper roof 95 and the base end portion 65 of the rails is resting 70 against the lower roof 100 surface. The method of using a ladder support assembly 50 comprising the steps of firstly providing the ladder support 50 as previously described. A second step of positioning 360 the angle beam 210 secondary leg portion 225 within the gutter 105 with the extension strut 150 resting 365 upon the lower roof 100, see FIGS. 6 and 8 through 10. A third step of raising 370 the channel shaped cross piece structure 170 to be even 375 with one of the plurality of ladder rungs 85, see FIGS. 2, 8, and 9. A fourth step of moving 380 the ladder 55 such that the ladder rung 85 in the third raising 370 step is received 200 by the channel shaped cross piece structure 170 through the open end 180 with the ladder rung 85 resting 205 against the closed end 185, see FIGS. 2, 8, and 9.

Further, on the method of using a ladder support 50, wherein the providing step further includes the means 340 for selectively adjusting 385 and locking 395 a strut 150 length 335 as previously described and further comprising a step of adjusting 385 the strut 150 length 335 between the previous steps of raising 370 and moving 380, wherein the adjusting step 385 includes dislodging 390 the pin 355 from the aperture 350 then subsequently adjusting 385 the strut 150 length 335 to bring the channel shaped cross piece structure 170 open end 180 adjacent to the ladder rung 85 in the raising step 370 and further inserting 395 the pin 355 into the aperture 350 to re-lock 395 the strut 150 length 335 and proceeding to the moving step 380, see FIGS. 7, 8, and 9.

In addition, on the method of using a ladder support 50 wherein the gutter 105 further includes the floor portion 110 that extends into the proximal sidewall 115 that is attached 120 to the lower roof 100 and the opposing side 125 of the floor portion 110 extends into the distal sidewall 130 forming for the gutter a "U" type cross section 135, see FIGS. 6 and 10. Further, the providing step additionally includes for the angle beam 210 in that the primary leg portion 220 and the secondary leg portion 225 are orientated in a perpendicular manner 250 to one another about the lengthwise axis 215. Wherein the primary leg portion 220 and the secondary leg portion 225 perpendicular orientation 250 is operational to dispose 245 the secondary leg portion 225 easier within various gutter 105 widths 145, see FIGS. 6 and 10, also the secondary leg portion 225 terminates in a secondary leg margin 260 that is positioned a maximum distance away 265 from the extension strut 150 first end portion 155, wherein the secondary leg margin 260 forms a straight edge 270 that is parallel 295 to the lengthwise axis 215 and perpendicular 280 to the longitudinal axis 165, see FIGS. 1, 6, and 10. Wherein operationally, the secondary leg margin 260 acts to more widely distribute 290 a force 285 along the longitudinal axis 165 toward the extension strut 150 first end portion 155 from the ladder 55 rung 85 to within the gutter 105 to reduce gutter area loading 290, wherein the positioning step 360 further includes aligning and nesting 400 the secondary leg margin 260 straight edge 270 into an interface 140 between the gutter floor portion 110 and the gutter distal sidewall 130 to maximize the distribution 290 (i.e. distributing the force 285 over a wider gutter 105 area) of the force 285 into the gutter 105, being primarily at the interface 140, so as to not damage the gutter 105 from the force 285.

CONCLUSION

Accordingly, the present invention of a ladder support has been described with some degree of particularity directed to the embodiments of the present invention. It should be appreciated, though; that the present invention is defined by the following claim construed in light of the prior art so modifications or changes may be made to the exemplary embodiments of the present invention without departing from the inventive concepts contained therein.

The invention claimed is:

1. A method of using a ladder support with a ladder, wherein the ladder includes a pair of rails each having a base end portion and an opposing free end portion, with the pair of rails having a plurality of perpendicularly positioned rungs disposed therebetween that are spaced apart from one another, further said ladder support is for use therebetween an upper roof and a lower roof with a gutter, wherein the free end portion of the rails is resting against the upper roof and the base end portion of the rails is resting against the lower roof, said method of using a ladder support comprising the steps of:

(a) providing said ladder support that consists of a telescopically adjustable extension strut having a first end and an opposing second end with a straight longitudinal axis spanning said first and second ends, further included in said ladder support is a curved bracket connected at said second end of said extension strut, said curved bracket comprising a first planar side with a first connector and a curved base connected to said first planar side to form said curved bracket, in addition said ladder support includes a substantially L-shaped bracket connected at said first end of said extension strut, said substantially L-shaped bracket comprises a first planar leg portion with a second connector and a second planar leg portion substantially perpendicular to said first planar leg portion forming said substantially L-shaped bracket, wherein said first planar side of said curved bracket and said first planar leg portion of said substantially L-shaped bracket are parallel to said longitudinal axis of said extension strut;

(b) positioning said substantially L-shaped bracket second planar leg portion within the gutter with said telescopically adjustable extension strut resting upon the lower roof;

(c) raising said curved bracket to be even with one of the plurality of ladder rungs; and (d) moving the ladder such that the ladder rung in step (c) is received by said curved bracket with the ladder rung resting against said curved base.

2. A method of using a ladder support according to claim 1 wherein said telescopically adjustable extension strut accommodates various distances as between the ladder rails base end portions and the gutter, wherein said telescopically adjustable extension strut is for selectively adjusting and locking a strut length, wherein said telescopically adjustable extension strut has a plurality of spaced apart apertures along said straight longitudinal axis that receive a removably engagable pin being operational to lock a selected strut length, and further comprising a step of adjusting said strut length between said steps (c) and (d), wherein said adjusting step includes dislodging said pin from said aperture then subsequently adjusting said strut length to bring said curved bracket curved base adjacent to the ladder rung in step (c) and further inserting said pin into said aperture to re-lock said strut length and proceeding to said step (d).

3. A method of using a ladder support according to claim 1 wherein the gutter further includes a floor portion that extends into a proximal sidewall that is attached to the lower roof and an opposing side of the floor portion extends into a distal sidewall forming for the gutter a "U" type cross section, wherein said second planar leg portion is operational to dispose within various gutter widths, also said second planar leg portion terminates in a terminating margin straight edge that is positioned a maximum distance away from said extension strut first end, wherein operationally said second planar leg portion terminating margin straight edge acts to more widely distribute a force along said longitudinal axis toward said extension strut first end from the ladder rung to within the gutter to reduce gutter area loading, wherein said positioning step further includes aligning and nesting said terminating margin straight edge into an interface between the gutter floor portion and the gutter distal sidewall to further distribute gutter loading from said force.

* * * * *